US012708244B2

(12) United States Patent
Zhang

(10) Patent No.: US 12,708,244 B2
(45) Date of Patent: Aug. 18, 2026

(54) CLEANING DEVICE, AND MONITORING METHOD AND APPARATUS OF CLEANING DEVICE

(71) Applicant: Beijing Xiaomi Mobile Software Co., Ltd., Beijing (CN)

(72) Inventor: Tiantian Zhang, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 795 days.

(21) Appl. No.: 17/955,061

(22) Filed: Sep. 28, 2022

(65) Prior Publication Data

US 2024/0000280 A1 Jan. 4, 2024

(30) Foreign Application Priority Data

Jun. 29, 2022 (CN) ..... 202210763105.7

(51) Int. Cl.
*A47L 11/40* (2006.01)

(52) U.S. Cl.
CPC ..... *A47L 11/4019* (2013.01); *A47L 11/4011* (2013.01); *A47L 11/4083* (2013.01)

(58) Field of Classification Search
None
See application file for complete search history.

(56) References Cited

U.S. PATENT DOCUMENTS

2022/0071464 A1 3/2022 Yang et al.

FOREIGN PATENT DOCUMENTS

| | | | | | |
|---|---|---|---|---|---|
| CN | 108143358 | A | * | 6/2018 | ..... A47L 11/28 |
| CN | 110200551 | A | * | 9/2019 | ..... A47L 11/4016 |
| CN | 110381289 | A | | 10/2019 | |
| CN | 211911503 | U | | 1/2020 | |
| CN | 110946523 | A | | 4/2020 | |
| CN | 111166249 | A | | 5/2020 | |
| CN | 210871321 | U | | 6/2020 | |
| CN | 112107221 | A | | 12/2020 | |
| CN | 112641388 | A | | 4/2021 | |
| CN | 113693500 | A | | 11/2021 | |
| CN | 113951768 | A | | 1/2022 | |
| KR | 20210025456 | A | | 3/2021 | |
| WO | 2020/125774 | A1 | | 6/2020 | |
| WO | 2021/027446 | A1 | | 2/2021 | |

OTHER PUBLICATIONS

Translation of CN_108143358 (Year: 2018).*
Translation of CN-110200551 (Year: 2019).*
(Continued)

*Primary Examiner* — Rita P Adhlakha
(74) *Attorney, Agent, or Firm* — Volpe Koenig

(57) ABSTRACT

A cleaning device including a main unit and a cleaning assembly, the cleaning assembly arranged on the main unit, where the cleaning assembly at least includes a water tank; and at least one image collection module, corresponding to the water tank in position and arranged facing the water tank, where the at least one image collection module collects an image of the water tank, so as to determine at least one of whether the water tank is in place and a water volume status of the water tank.

19 Claims, 6 Drawing Sheets

(56) References Cited

OTHER PUBLICATIONS

Chen Duan-ping, Yang Wen-shun; Design Vision Deviation Adjusting Control System Based on PLC; Automation & Instrumentation;Mar. 15, 2017; vol. 032, No. 3.;pp. 65-68; Tianjin Industrial Automation Instrumentation Research Institute, Tianjin Automation Society; [CN] (2017).

Mao Jiafa, Hu Haibiao, Cheng Zhenbo, Fan Weikang, Lu Jiwei, Xiao Gang; Study on identification and tracking of half-occlusion target fish; Journal of Zhejiang University of Technology ; Apr. 25, 2015; vol. 45, No. 2.;pp. 65-68;pp. 207-211; Zhejiang University of Technology; [CN] (2015).

Extended European Search Report issued on Jun. 6, 2023 for European Patent Application No. 22198579.9.

Chinese Office Action issued on Jun. 30, 2023 for Chinese Patent Application No. 2022107631057.

* cited by examiner

CLEANING DEVICE, AND MONITORING METHOD AND APPARATUS OF CLEANING DEVICE

CROSS REFERENCE TO RELATED APPLICATIONS

The present application is based on and claims the priority to Chinese patent application No. 202210763105.7, field on Jun. 29, 2022, the entire contents of which are incorporated herein by reference for all purposes.

BACKGROUND

A cleaning device, such as an intelligent sweeping and mopping robot, can automatically complete household cleaning, including sweeping, dust removal, rag mopping and the like, which greatly liberates people's hands and time. A water tank is a main component of the cleaning device, which can automatically replenish water to a rag in a sweeping and mopping process.

SUMMARY

The disclosure relates to the technical field of cleaning devices, in particular to a cleaning device, and a monitoring method and apparatus of the cleaning device.

A first aspect of the disclosure provides a cleaning device, including: a main unit; a cleaning assembly, arranged on the main unit, where the cleaning assembly at least includes a water tank; and at least one image collection module, corresponding to the water tank in position and arranged facing the water tank, where the at least one image collection module collects an image of the water tank, so as to determine at least one of whether the water tank is in place and a water volume status of the water tank.

According to a second aspect of the disclosure, a monitoring method of a cleaning device is provided and applied to a cleaning device, the method includes: acquiring an image of a water tank included in a cleaning assembly, arranged on a main unit, wherein the cleaning assembly at least comprises the water tank; and determining at least one of whether the water tank is in place and a water volume status of the water tank according to the image of the water tank using at least one image collection module, corresponding to the water tank in position and arranged facing the water tank, wherein the at least one image collection module collects an image of the water tank, so as to determine at least one of whether the water tank is in place and a water volume status of the water tank.

According to a third aspect of the disclosure, a monitoring apparatus of a cleaning device is provided and applied to a cleaning device, the cleaning device includes: a main unit; a cleaning assembly, arranged on the main unit, where the cleaning assembly at least includes a water tank; and at least one image collection module, corresponding to the water tank in position and arranged facing the water tank, where the at least one image collection module collects an image of the water tank, so as to determine whether the water tank is in place and/or a water volume status of the water tank. The apparatus includes: a first acquiring unit, acquiring an image of a water tank; and a first processing unit, determining whether the water tank is in place and/or a water volume status of the water tank according to the image of the water tank.

According to a fourth aspect of the disclosure, a non-temporary computer-readable storage medium is provided, the computer-readable storage medium stores computer instructions, and the computer instructions, when executed by a processor, implement the following steps of the monitoring method of the cleaning device. Acquiring an image of a water tank included in a cleaning assembly, arranged on a main unit, wherein the cleaning assembly at least comprises the water tank; and determining at least one of whether the water tank is in place and a water volume status of the water tank according to the image of the water tank using at least one image collection module, corresponding to the water tank in position and arranged facing the water tank, wherein the at least one image collection module collects an image of the water tank, so as to determine at least one of whether the water tank is in place and a water volume status of the water tank.

It should be understood that the above general descriptions and the following detailed descriptions are merely explanatory and illustrative, and cannot limit the disclosure.

DETAILED DESCRIPTION

Examples will be described in detail here, and instances are shown in the accompanying drawings. When the following description refers to the accompanying drawings, unless otherwise indicated, the same numbers in different accompanying drawings indicate the same or similar elements. The implementations described in the following examples do not represent all implementations consistent with the disclosure. Rather, they are merely instances of apparatuses and methods consistent with some aspects of the disclosure.

The terms used in the disclosure are merely for the purpose of describing specific examples, and not intended to limit the disclosure. Unless otherwise defined, technical or scientific terms used in the disclosure shall have the ordinary meanings understood by those ordinarily skilled in the art to which the disclosure pertains. The words "first", "second"

and the similar words used in the disclosure do not indicate any order, quantity or importance, but are merely used to distinguish different components. As such, nor "one" or "a" or similar words indicate quantity limitations, but indicate at least one. If merely "one" is referred to, it will be explained separately. "A plurality of" or "several" means two or more than two. Unless otherwise indicated, "front", "rear", "lower" and/or "upper", "top", "bottom" and other similar words are merely for convenience of description and are not limited to one location or a spatial orientation. "Comprise" or "include" and other similar words indicate that an element or item appearing before "comprise" or "include" covers listed elements or items appearing after "comprise" or "include" and their equivalents, and do not exclude other elements or items. "Connect" or "couple" and the similar words are not limited to physical or mechanical connection, but also may include electrical connection, whether direct or indirect.

A cleaning device, such as an intelligent sweeping and mopping robot, can automatically complete household cleaning, including sweeping, dust removal, rag mopping and the like, which greatly liberates people's hands and time. A water tank is a main component of the cleaning device, which can automatically replenish water to a rag in a sweeping and mopping process. In the related art, the water volume detection of the water tank is usually realized based on a principle of a photoelectric sensor or a principle of Hall detection combined with a principle of magnetic floating, which has the problems of many related components and complex structures and principles.

The disclosure provides a cleaning device, and a monitoring method and apparatus of the cleaning device, so as to solve the related technical problems.

Figure 1:
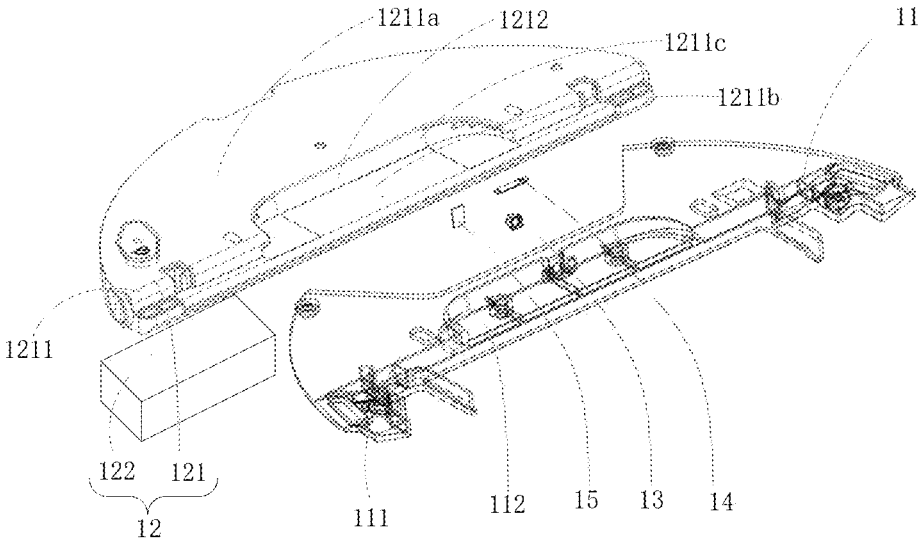
FIG. 1 is a schematic diagram of an exploded structure of a cleaning device in an example of the disclosure.
Figure 2:
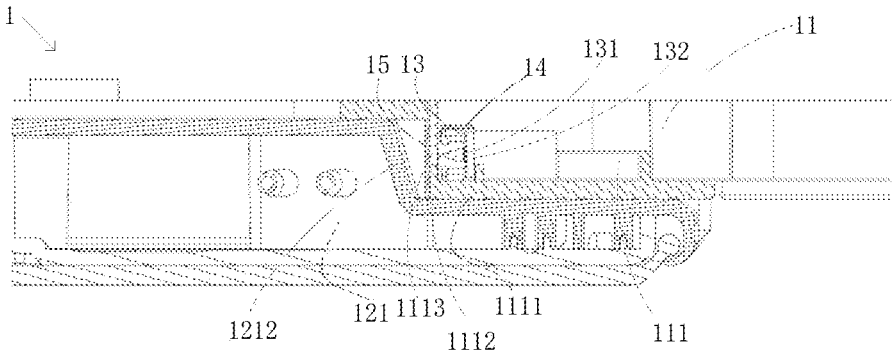
FIG. 2 is a schematic cross-sectional view of a cleaning device in an example of the disclosure.

The disclosure provides a cleaning device. FIG. 1 is a schematic diagram of an exploded structure of the cleaning device in an example of the disclosure, and FIG. 2 is a schematic cross-sectional view of the cleaning device in an example of the disclosure. As shown in FIG. 1 and FIG. 2, the cleaning device 1 includes a main unit 11, a cleaning assembly 12 and at least one image collection module 13. The cleaning assembly 12 is arranged on the main unit 11, and the cleaning assembly 12 at least includes a water tank 121. The at least one image collection module 13 corresponds to the water tank 121 in position and is arranged facing the water tank 121. The at least one image collection module 13 collects an image of the water tank, so as to determine at least one of whether the water tank 121 is in place and a water volume status of the water tank 121.

The image of the water tank is collected through the image collection module 13 corresponding to the water tank 121 in position, and a water level of the water tank 121 and whether the water tank 121 is in place are determined through the image of the water tank. The judgment logic is simple and intuitive, the number of components and structural arrangement of the cleaning device 1 are simplified, and an accuracy of water level monitoring and installation positioning of the water tank 121 are improved.

In some examples, the main unit 11 includes an image analysis module, the image analysis module is electrically connected to the image collection module 13, so as to acquire and analyze the image of the water tank and determine the water volume status of the water tank 121. The image of the water tank may be processed and analyzed through the image analysis module of the main unit 11. The image analysis module may further be configured to determine the water volume status of the water tank 121, which improves an analysis efficiency and accuracy of the image of the water tank.

In some examples, the cleaning device 1 further includes a limit fixing piece 14, the limit fixing piece 14 is in limit fit with the image collection module 13, and the limit fixing piece 14 is fixedly connected to the main unit 11. The image collection module 13 is fixedly assembled on the main unit 11 through the limit fixing piece 14, which improves a position accuracy and assembly reliability of the image collection module 13. In addition, the image collection module 13 is assembled on the main unit 11, and the image collection module 13 is not disassembled with the water tank 121 relative to the main unit 11, which avoids the influence on the image collection module 13 in a process of disassembling the water tank 121 and adding water.

In the above examples, the limit fixing piece 14 may be a cover plate, the cover plate is arranged above the image collection module 13 in a thickness direction of the cleaning device 1, and the cover plate is fixedly connected to the main unit 11. A limiting area of the image collection module 13 may be increased through the cover plate, the cover plate is above the image collection module 13, and the cover plate is fixedly connected to the main unit 11, which can avoid a position shift of the image collection module 13 in multiple directions caused by motion turbulence of the cleaning device 1 during use.

In some examples, the main unit 11 includes a bottom plate 111. The cleaning device 1 further includes a light transmission piece 15 assembled on the bottom plate 111 and located between the image collection module 13 and the water tank 121. The image collection module 13 includes a main body structure 131 and a lens 132 arranged on the main body structure 131, and the light transmission piece the limit fixing piece 14, the bottom plate 111 and the main body structure 131 enclose a sealed space for accommodating the lens 132. Sealing with the lens 132 is realized through the light transmission piece 15, the limit fixing piece 14, the bottom plate 111 and the main body structure 131, and dustproof and waterproof functions of the lens 132 are realized on the condition that a shooting function of the lens 132 is ensured. It needs to be noted that the above light transmission piece 15 may be a light transmission optic.

In the above examples, the bottom plate 111 includes a base plate 1111 and an extension wall 1112 arranged on the base plate 1111, and the extension wall 1112 is provided with an open hole 1113 corresponding to the lens 132 in position. The light transmission piece 15 is adhered to the extension wall 1112 through a sealing adhesive, and the light transmission piece 15 blocks the open hole 1113. The light transmission piece 15 is adhered, fixed and assembled through the extension wall 1112, which improves an assembly convenience of the light transmission piece 15, and can further ensure the assembly reliability of the light transmission piece 15.

In some examples, the image collection module 13 may also be fixedly assembled on the water tank 121. The image collection module 13 may be detachable fitted to the main unit 11 along with the water tank 121, and a relative positional relationship between the image collection module 13 and the water tank 121 is fixed, which prevents a presented water level and positioning accuracy of the water tank 121 from being affected by the change of the relative positional relationship between the water tank 121 and the image collection module 13 in the disassembling process.

In some examples, the water tank 121 includes a housing 1211 that encloses a water storage space and a water level observation part 1212 arranged on the housing 1211, so that the image collection module 13 can shoot a water level image through the water level observation part 1212. An assembly surface 1211*a* of the housing 1211 facing the main unit 11 is provided with a concave part 1211*b* recessed relative to the assembly surface 1211*a*, and the main unit 11 includes an assembly structure 112 fitted to the concave part 1211*b*. The image collection module 13 is assembled into an assembly space enclosed by the assembly structure 112, and the water level observation part 1212 is arranged on a first side wall 1211*c* forming the concave part 1211*b*. The assembly structure 112 of the main unit is in fit with the concave part 1211*b*, on the one hand, it facilitates the positioning and assembly of the main unit 11 and the water tank 121, and on the other hand, the water level observation part 1212 is arranged on the first side wall 1211*c* formed by the concave part 1211*b*, which facilitates the image collection module 13 located in the assembly space and corresponding to the water level observation part 1212 in position, so as to perform collection of the image of the water tank.

In the above examples, the first side wall 1211*c* may be arranged obliquely relative to the assembly surface 1211*a*, so as to increase a space between the first side wall 1211*c* and the main unit 11, on the one hand, structural interference between the water tank 121 and the main unit 11 is avoided, and on the other hand, the image collection of the image collection module 13 is facilitated.

In the above examples, the water level observation part 1212 may be a light transmission structure that forms at least a portion of the first side wall 1211*c*, and a water level situation in the water tank 121 can be directly observed through the light transmission structure.

In some examples, the water tank 121 includes a first positioning part, and the image of the water tank includes an image of the first positioning part, so as to judge whether the water tank 121 is in place according to the image of the first positioning part. The first positioning part may be a structure at a specific position of the water tank 121, when a relative positional relationship between the first positioning part and the main unit 11 meets a preset condition in the image, it may be determined that the water tank 121 is in place.

In some examples, the cleaning assembly 12 includes a dust box 122. The at least one image collection module 13 corresponds to a second positioning part of the dust box 122 in position, and the image collection module 13 acquires the image of the second positioning part, so as to judge whether the dust box 122 is in place according to the image of the second positioning part. Similarly, the second positioning part may be a structure at a specific position of the dust box 122, when a relative positional relationship between the second positioning part and the main unit 11 meets a preset condition in the image, it may be determined that the dust box 122 is in place.

In the above examples, position images of the first positioning part of the water tank 121 and the second positioning part of the dust box 122 are respectively collected through the image collection module 13, which can judge whether the water tank 121 or the dust box 122 is assembled in place.

In other examples, whether other components assembled to the main unit 11 are assembled in place may further be observed through the image collection module 13, and its judgment solution is the same as a judgment solution of whether the above water tank 121 and the dust box 122 are in place, which will not repeated here.

Figure 3:
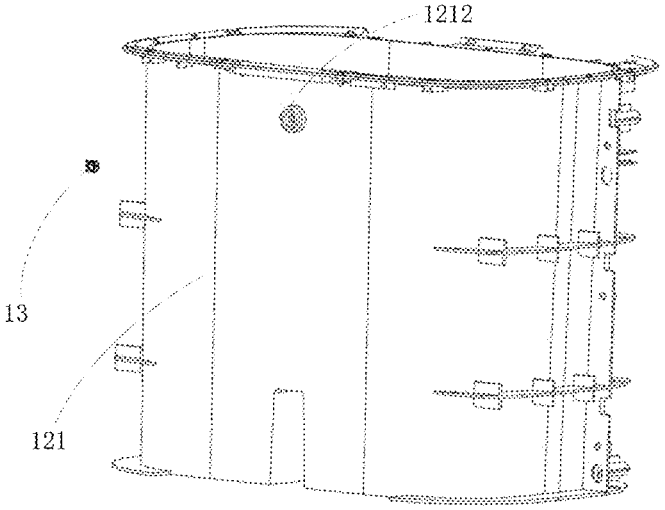
FIG. 3 is a schematic diagram of an exploded structure of a water tank and an image collection module in an example of the disclosure.
Figure 4:
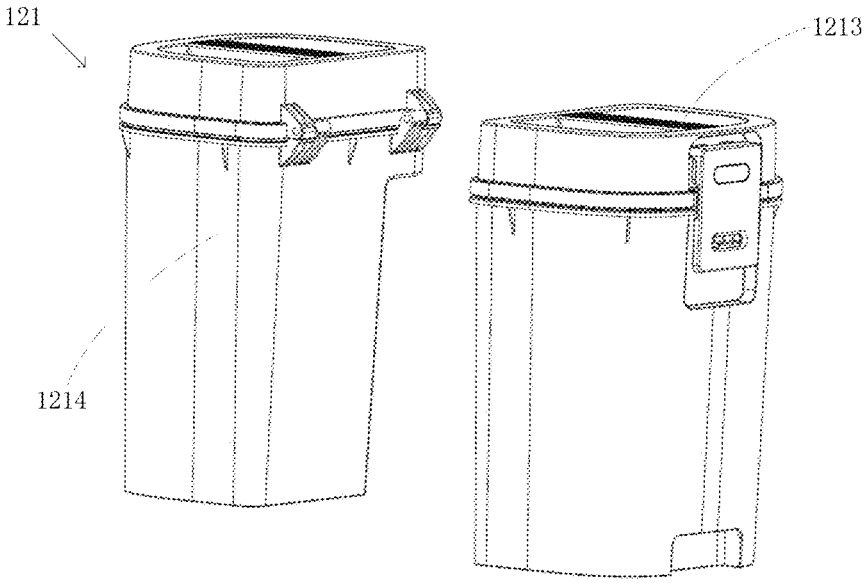
FIG. 4 is a schematic diagram of an exploded structure of a clean water tank and a dirty water tank in an example of the disclosure.

In the above examples, the cleaning device 1 may include a base station and/or a cleaning main body, and the main unit 11 includes a base station main unit or a cleaning main body main unit. That is, the cleaning device 1 may be the base station, and may also be the cleaning main body movable relative to the base station. As shown in FIG. 3, when the cleaning device 1 is the cleaning main body, the water tank 121 may be a clean water tank 3, and whether a water volume status of the clean water tank is in place may be observed through the image collection module 13. When the cleaning device 1 is the base station, as shown in FIG. 4, the water tank 121 may be a clean water tank 1213 or a dirty water tank 1214, water volume statuses of the clean water tank 1213 and the dirty water tank 1214 and whether the clean water tank 1213 and the dirty water tank 1214 are in place may be observed through the image collection module 13.

It needs to be noted that the image collection module 13 may be a camera, a scanning device and the like, which is not limited by the disclosure. The above cleaning device 1 may be a floor sweeping robot, a glass cleaning device, a bed sweeping device and the like, which is not limited by the disclosure.

Figure 5:
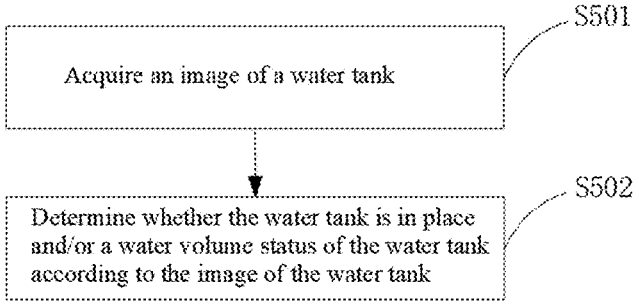
FIG. 5 is a flow chart of a monitoring method of a cleaning device in an example of the disclosure.

The disclosure further provides a monitoring method of a cleaning device, applied to the above cleaning device 1. FIG. 5 is a flow chart of a monitoring method of a cleaning device in an example of the disclosure. As shown in FIG. 5, the monitoring method of the cleaning device 1 may be implemented by the following steps.

In step S501, an image of a water tank is acquired.

In step S502, it is determined whether the water tank 121 is in place and/or what a water volume status of the water tank 121 is according to the image of the water tank.

The image of the water tank is collected through an image collection module 13 corresponding to the water tank 121 in position, and a water level of the water tank 121 and whether the water tank 121 is in place are determined through the image of the water tank. The judgment logic is simple and intuitive, the number of components and structural arrangement of the cleaning device 1 are simplified, and an accuracy of water level monitoring and installation positioning of the water tank 121 is improved.

In the above examples, determining the water volume status of the water tank 121 according to the image of the water tank may include: a signal that the water tank 121 is in a full-tank water volume status is sent in a case that the image of the water tank matches an image feature of a preset full-tank water level; a signal that the water tank 121 is in a half-tank water volume status is sent in a case that the image of the water tank matches an image feature of a preset half-tank water level; and a signal that the water tank 121 is in an empty-tank water volume status is sent in a case that the image of the water tank matches an image feature of a preset empty-tank water level. A current water volume status of the water tank 121 is confirmed through image comparison, a user is reminded that the water tank is in a status of full water, water shortage and empty tank according to the water volume status, so that the user may add water to the clean water tank in a status of water shortage of the clean water tank and drain water in a status of full water of the dirty water tank, and the judgment logic is simple and easy to realize.

Figure 6:
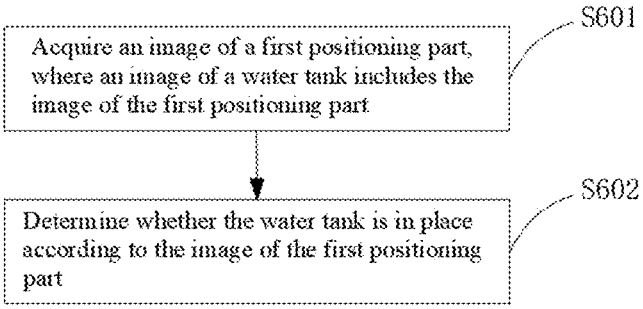
FIG. 6 is a flow chart of a monitoring method of a cleaning device in another example of the disclosure.

The water tank 121 includes a first positioning part. FIG. 6 is a flow chart of a monitoring method of a cleaning device in another example of the disclosure. As shown in FIG. 6, determining whether the water tank is in place according to the image of the water tank may be implemented by the following steps.

In step S601, an image of the first positioning part is acquired, where the image of the water tank includes the image of the first positioning part.

In step S602, whether the water tank is in place is determined according to the image of the first positioning part.

Figure 7:
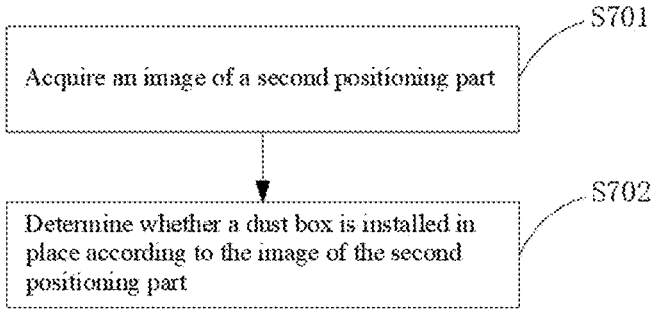
FIG. 7 is a flow chart of a monitoring method of a cleaning device in yet another example of the disclosure.

In some examples, a cleaning assembly 12 includes a dust box 122, and the dust box 122 includes a second positioning part. FIG. 7 is a flow chart of a monitoring method of a cleaning device in yet another example of the disclosure. As shown in FIG. 7, the monitoring method of the cleaning device may be implemented by the following steps.

In step S701, an image of the second positioning part is acquired.

In step S702, whether the dust box 122 is in place is determined according to the image of the second positioning part.

The images of the first positioning part of the water tank 121 and the second positioning part of the dust box 122 are respectively collected through the image collection module 13, which can judge whether the water tank 121 or the dust box 122 is assembled in place, and the judgment logic is simple and easy to realize.

Figure 8:
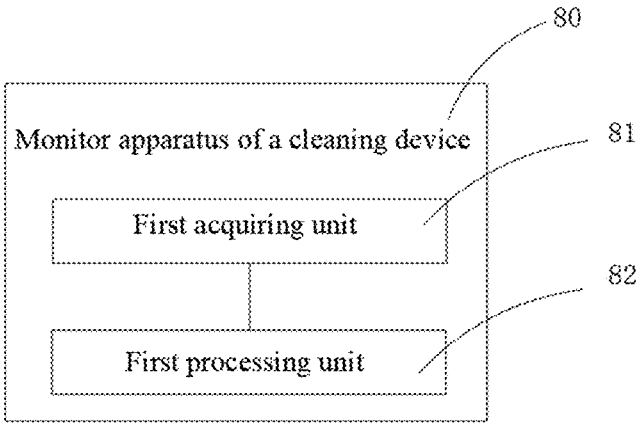
FIG. 8 is a structural block diagram of a monitoring apparatus of a cleaning device in an example of the disclosure.

The disclosure further provides a monitoring apparatus of a cleaning device 1, applied to the above cleaning device 1. FIG. 8 is a structural block diagram of a monitoring apparatus of the cleaning device in an example of the disclosure. As shown in FIG. 8, the monitoring apparatus 80 of the cleaning device 1 includes: a first acquiring unit 81 and a first processing unit 82.

The first acquiring unit 81 is configured to acquire an image of a water tank.

The first processing unit 82 is configured to determine whether the water tank 121 is in place and/or a water volume status of the water tank 121 according to the image of the water tank.

The first processing unit may include: a first processing subunit, a second processing subunit and a third processing subunit.

The first processing subunit is configured to send a signal that the water tank 121 is in a full-tank water volume status in a case that the image of the water tank matches an image feature of a preset full-tank water level.

The second processing subunit is configured to send a signal that the water tank 121 is in a half-tank water volume status in a case that the image of the water tank matches an image feature of a preset half-tank water level.

The third processing subunit is configured to send a signal that the water tank 121 is in an empty-tank water volume status in a case that the image of the water tank matches an image feature of a preset empty-tank water level.

Figure 9:
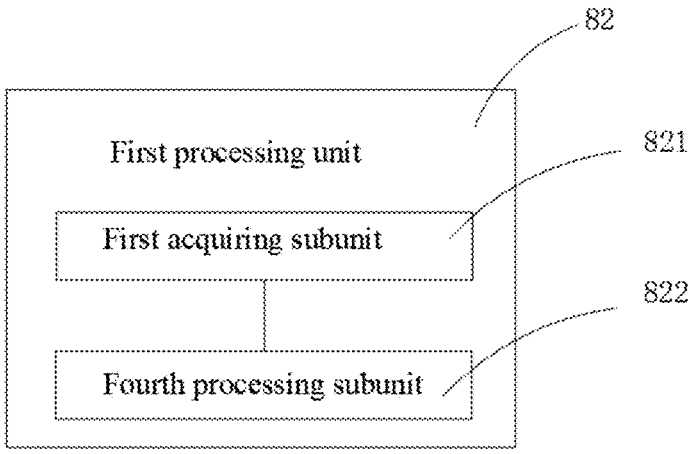
FIG. 9 is a structural block diagram of a monitoring apparatus of a cleaning device in another example of the disclosure.

The water tank 121 includes a first positioning part. FIG. 9 is a structural block diagram of a monitoring apparatus of a cleaning device in another example of the disclosure. As shown in FIG. 9, the first processing unit 82 may include a first acquiring subunit 821 and a fourth processing subunit 822.

The first acquiring subunit 821 is configured to acquire an image of the first positioning part. The image of the water tank includes the image of the first positioning part.

The fourth processing subunit 822 is configured to determine whether the water tank is in place according to the image of the first positioning part.

Figure 10:
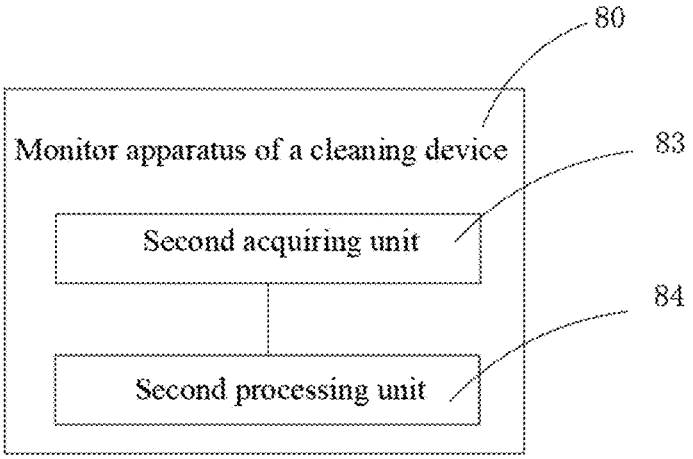
FIG. 10 is a structural block diagram of a monitoring apparatus of a cleaning device in yet another example of the disclosure.

A cleaning assembly 12 may include a dust box 122, and the dust box 122 includes a second positioning part. FIG. 10 is a structural block diagram of a monitoring apparatus of a cleaning device in yet another example of the disclosure. As shown in FIG. 10, the monitoring apparatus 80 of the cleaning device 1 further includes: a second acquiring unit 83 and a second processing unit 84.

The second acquiring unit 83 is configured to acquire an image of the second positioning part.

The second processing unit 84 is configured to determine whether the dust box 122 is installed in place according to the image of the second positioning part.

As for the apparatus in the above examples, the specific manner in which each module performs operations has been described in detail in the examples of the method, and detailed description will not be given here.

As for the apparatus examples, as it basically corresponds to the method examples, the related parts can take reference to the partial description of the method examples. The apparatus examples described above are merely illustrative. The units described as separate components may or may not be physically separated, and the components displayed as units may or may not be physical unit, that is, they may be located in one place, or may be distributed to multiple network units. Some or all of the modules may be selected according to actual needs to realize the purpose of the solution of the disclosure. Those of ordinary skill in the art can understand and implement it without creative work.

Accordingly, the disclosure further provides an apparatus for cleaning device monitoring, including: a processor; and a memory configured to store processor-executable instructions. The processor is configured to: acquire an image of a water tank; and determine whether the water tank is in place and/or a water volume status of the water tank according to the image of the water tank.

Figure 11:
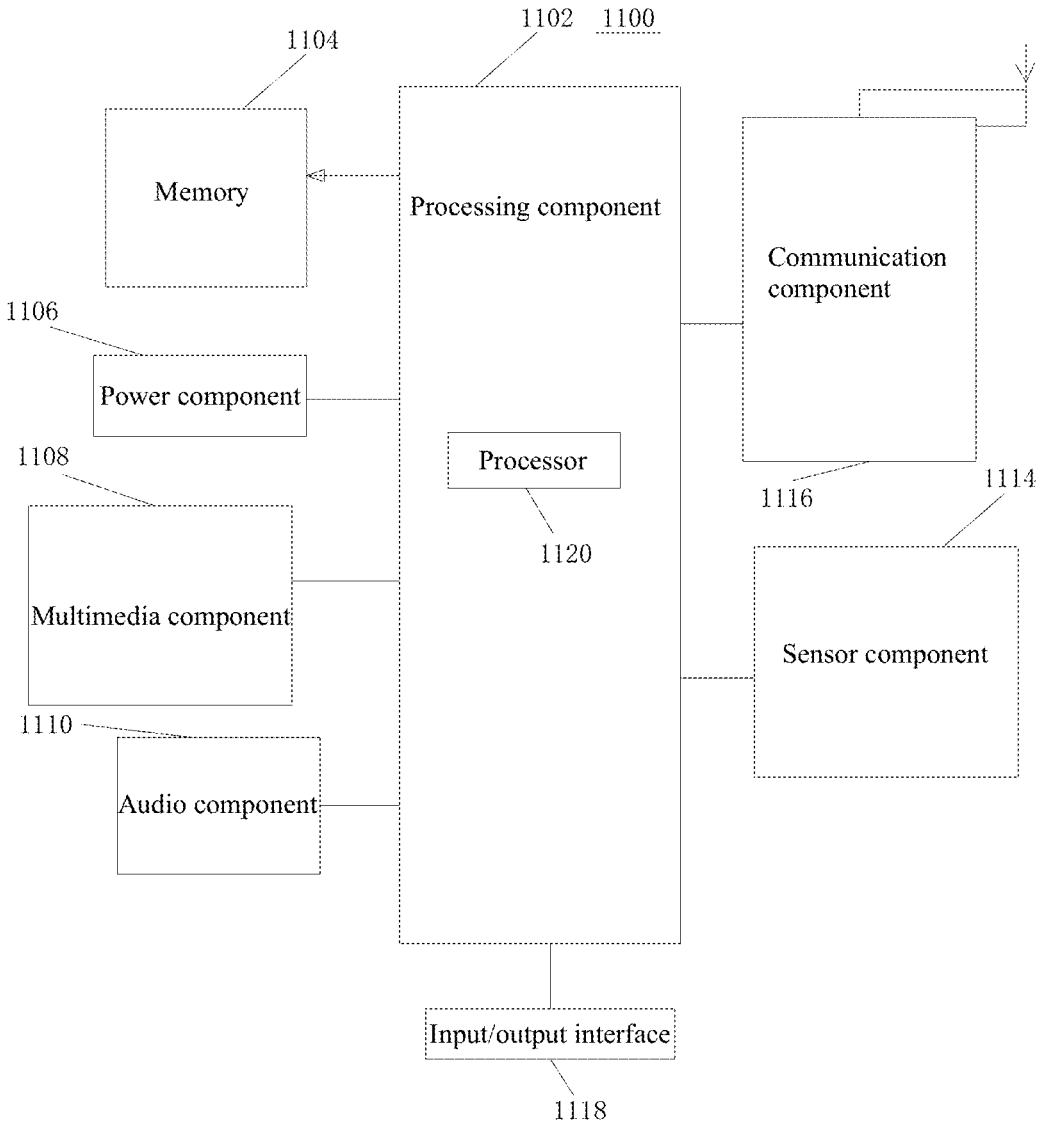
FIG. 11 is a block diagram of an apparatus for cleaning device monitoring illustrated by an example.

FIG. 11 is a block diagram of an apparatus for cleaning device monitoring illustrated by an example. For example, an apparatus 1100 may be a mobile phone, a computer, a digital broadcasting terminal, a messaging device, a game console, a tablet device, a medical device, a fitness device, a personal digital assistant, etc.

Referring to FIG. 11, the apparatus 1100 may include one or more of the following components: a processing component 1102, a memory 1104, a power component 1106, a multimedia component 1108, an audio component 1110, an input/output (I/O) interface 1118, a sensor component 1114, and a communication component 1116.

The processing component 1102 typically controls an overall operation of the apparatus 1100, such as operations associated with display, telephone call, data communication, camera operations, and recording operations. The processing component 1102 may include one or more processors 1120 to execute instructions to complete all or part of the steps of the above method. In addition, the processing component 1102 may include one or more modules to facilitate interaction between the processing component 1102 and other components. For example, the processing component 1102 may include a multimedia module to facilitate interaction between the multimedia component 1108 and the processing component 1102. The one or more processors 1120 may include one or more of the processing subunits.

The memory 1104 is configured to store various types of data to support operations at the apparatus 1100. Instances of these data include instructions for any application or method operating on the apparatus 1100, contact data, phonebook data, messages, pictures, videos, etc. The memory 1104 may be implemented by any type of volatile or nonvolatile storage device or their combination, such as a static random access memory (SRAM), an electrically erasable programmable read only memory (EEPROM), an erasable programmable read only memory (EPROM), a programmable read only memory (PROM), a read only memory (ROM), a magnetic memory, a flash memory, a magnetic disk or an optic disk.

The power component 1106 provides power for various components of the apparatus 1100. The power component 1106 may include a power management system, one or more power sources and other components associated with generating, managing and distributing power for the apparatus 1100.

The multimedia component 1108 includes a screen providing an output interface between the apparatus 1100 and a user. In some examples, the screen may include a liquid crystal display (LCD) and a touch panel (TP). If the screen includes the touch panel, the screen may be implemented as a touch screen to receive an input signal from the user. The touch panel includes one or more touch sensors to sense touch, sliding and gestures on the touch panel. The touch sensor cannot merely sense the boundary of the touch or sliding operation, but also detect the duration and pressure related to the touch or sliding operation. In some examples, the multimedia component 1108 includes a front camera and/or a rear camera. When the apparatus 1100 is in an operation mode, such as a shooting mode or a video mode, the front camera and/or the rear camera can receive external multimedia data. Each front camera and rear camera can be a fixed optical lens system or have a focal length and optical zoom capability.

The audio component 1110 is configured to output and/or input audio signals. For example, the audio component 1110 includes a microphone (MIC) configured to receive an external audio signal when the apparatus 1100 is in the operation mode, such as a call mode, a recording mode, and a speech recognition mode. The received audio signal may be further stored in the memory 1104 or transmitted via the communication component 1116. In some examples, the audio component 1110 further includes a speaker for outputting an audio signal.

The I/O interface 1118 provides an interface between the processing component 1102 and a peripheral interface module which can be a keyboard, a click wheel, a button, etc. These buttons may include but are not limited to: a home button, volume buttons, a start button and a lock button.

The sensor component 1114 includes one or more sensors for providing state evaluation of various aspects of the apparatus 1100. For example, the sensor component 1114 can detect an on/off state of the apparatus 1100 and the relative positioning of the components, for example, the component is a display and a keypad of the apparatus 1100. The sensor component 1114 can also detect the change of the position of the apparatus 1100 or one component of the apparatus 1100, the presence or absence of user contact with the apparatus 1100, the azimuth or acceleration/deceleration of the apparatus 1100, and temperature change of the apparatus 1100. The sensor component 1114 may include a proximity sensor configured to detect the presence of nearby objects without any physical contact. The sensor component 1114 may further include an optical sensor, such as a CMOS or CCD image sensor, for use in imaging applications. In some examples, the sensor component 1114 may further include an acceleration sensor, a gyroscope sensor, a magnetic sensor, a pressure sensor, or a temperature sensor.

The communication component 1116 is configured to facilitate wired or wireless communication between the apparatus 1100 and other devices. The apparatus 1100 may access a wireless network based on a communication standard, such as WiFi, 2G or 14G, 4G LTE, 5G NR or their combination. In an example, the communication component 1116 receives a broadcast signal or broadcast-related information from an external broadcast management system via a broadcast channel. In an example, the communication component 1116 further includes a near field communication (NFC) module to facilitate short-range communication. For example, the NFC module may be implemented based on a radio frequency identification (RFID) technology, an infrared data association (IrDA) technology, an ultra wideband (UWB) technology, a Bluetooth (BT) technology and other technologies.

In an example, the apparatus 1100 may be implemented by one or more application-specific integrated circuits (ASICs), digital signal processors (DSPs), digital signal processing devices (DSPDs), programmable logic devices (PLDs), field programmable gate arrays (FPGAs), controllers, microcontrollers, microprocessors, or other electronic elements for performing the above method.

The disclosure further provides a computer-readable storage medium, the computer-readable storage medium stores computer instructions, and the computer instructions, when executed by a processor, implement steps of the above monitoring method of the cleaning device. In an example, a non-temporary computer-readable storage medium including instructions is further provided, such as the memory 1104 including instructions, which can be executed by the processor 1120 of the apparatus 1100 to complete the above monitoring method of the cleaning device. For example, the non-temporary computer-readable storage medium may be a ROM, a random access memory (RAM), a CD-ROM, a magnetic tape, a floppy disk, an optical data storage device, etc.

The above merely involves preferred examples of the disclosure and are not used to limit the disclosure, and any modification, equivalent replacement, improvement, etc. made within the spirit and principles of the disclosure should be included in the scope of protection of the disclosure.

Embodiments

A first embodiment includes a cleaning device, the cleaning device includes a main unit and a cleaning assembly, the cleaning assembly is arranged on the main unit, where the cleaning assembly at least includes a water tank; and at least one image collection module, corresponding to the water tank in position and arranged facing the water tank, where the at least one image collection module collects an image of the water tank, so as to determine whether the water tank is in place and/or a water volume status of the water tank.

A second embodiment includes the cleaning device of the first embodiment, in which the main unit includes an image analysis module, and the image analysis module is electrically connected to the image collection module, so as to acquire and analyze the image of the water tank.

A third embodiment includes the cleaning device of the first embodiment, in which the cleaning device further includes a limit fixing piece, the limit fixing piece is in limit fit with the image collection module, and the limit fixing piece is fixedly connected to the main unit.

A fourth embodiment includes the cleaning device of the third embodiment, in which the limit fixing piece includes a cover plate, the cover plate is arranged above the image collection module in a thickness direction of the cleaning and the cover plate is fixedly connected to the main unit.

A fifth embodiment includes the cleaning device of the third embodiment, in which the main unit includes a bottom plate, and the cleaning device further includes a light transmission piece assembled on the bottom plate and located between the image collection module and the water tank; and the image collection module includes a main body structure and a lens arranged on the main body structure, and the light transmission piece, the limit fixing piece, the bottom plate and the main body structure enclose a sealed space for accommodating the lens.

A sixth embodiment includes the cleaning device of the fifth embodiment, in which the bottom plate includes a base plate and an extension wall arranged on the base plate, and the extension wall is provided with an open hole corresponding to the lens in position; and the light transmission piece is adhered to the extension wall by a sealing adhesive, and the light transmission piece blocks the open hole.

A seventh embodiment includes the cleaning device of the first embodiment, in which the image collection module is fixedly assembled on the water tank.

A eighth embodiment includes the cleaning device of the first embodiment, in which the water tank includes a housing that encloses a water storage space and a water level observation part arranged on the housing; and an assembly surface of the housing facing the main unit is provided with a concave part recessed relative to the assembly surface, and the main unit includes an assembly structure fitted to the concave part; and the image collection module is assembled into an assembly space enclosed by the assembly structure, and the water level observation part is arranged on a first side wall forming the concave part.

A ninth embodiment includes the cleaning device of the eighth embodiment, in which the first side wall is arranged obliquely relative to the assembly surface.

A tenth embodiment includes the cleaning device of the eighth embodiment, in which the water level observation part includes a light transmission structure forming at least a portion of the first side wall.

A eleventh embodiment includes the cleaning device according to any one of the first to tenth embodiment, in which the water tank includes a first positioning part; and the image of the water tank includes an image of the first positioning part, so as to judge whether the water tank is in place according to the image of the first positioning part.

A twelfth embodiment includes the cleaning device according to any one of the first to eleventh embodiment, in which the cleaning assembly further includes a dust box; and the at least one image collection module corresponds to a second positioning part of the dust box in position, and the image collection module acquires an image of the second positioning part, so as to judge whether the dust box is in place according to the image of the second positioning part.

A thirteenth embodiment includes the cleaning device according to any one of the first to twelfth embodiment, in which the cleaning device includes a base station and/or a cleaning main body; the water tank includes a clean water tank or a dirty water tank; and/or, the main unit includes a base station main unit or a cleaning main body main unit.

A fourteenth includes a monitoring method of a cleaning device, and applied to a cleaning device and the cleaning device according to any one of the first to thirteenth embodiments, and the method includes: acquiring an image of a water tank; and determining whether the water tank is in place and/or a water volume status of the water tank according to the image of the water tank.

A fifteenth embodiment includes the monitoring method of a cleaning device of the fourteenth embodiment, in which determining the water volume status of the water tank according to the image of the water tank, includes: sending a signal that the water tank is in a full-tank water volume status in a case that the image of the water tank matches an image feature of a preset full-tank water level; sending a signal that the water tank is in a half-tank water volume status in a case that the image of the water tank matches an image feature of a preset half-tank water level; and sending a signal that the water tank is in an empty-tank water volume status in a case that the image of the water tank matches an image feature of a preset empty-tank water level.

A sixteenth embodiment includes the monitoring method of a cleaning device of the fourteenth or fifteenth embodiment, in which the water tank includes a first positioning part, and determining whether the water tank is in place according to the image of the water tank includes: acquiring an image of the first positioning part, where the image of the water tank includes the image of the first positioning part; and determining whether the water tank is in place according to the image of the first positioning part.

A seventeenth embodiment includes the monitoring method of a cleaning device according to any one of the fourteenth or sixteenth embodiment, in which a cleaning assembly includes a dust box, and the dust box includes a second positioning part; and the method further includes: acquiring an image of the second positioning part; and determining whether the dust box is in place according to the image of the second positioning part.

A eighteenth embodiment includes a monitoring apparatus of a cleaning device is and the monitoring apparatus of a cleaning device is applied to a cleaning device and the cleaning device according to any one of the first to thirteenth embodiments, and the apparatus includes: a first acquiring unit, acquiring an image of a water tank; and a first processing unit, determining whether the water tank is in place and/or a water volume status of the water tank according to the image of the water tank.

A nineteenth embodiment includes the monitoring apparatus of a cleaning device of the eighteenth embodiment, in which the first processing unit includes: a first processing subunit, sending a signal that the water tank is in a full-tank water volume status in a case that the image of the water tank matches an image feature of a preset full-tank water level; a second processing subunit, sending a signal that the water tank is in a half-tank water volume status in a case that the image of the water tank matches an image feature of a preset half-tank water level; and a third processing subunit, sending a signal that the water tank is in an empty-tank water volume status in a case that the image of the water tank matches an image feature of a preset empty-tank water level.

A twentieth embodiment includes the monitoring apparatus of a cleaning device of the eighteenth or nineteenth embodiment, in which the water tank includes a first positioning part, and the first processing unit includes: a first acquiring subunit, acquiring an image of the first positioning part, where the image of the water tank includes the image of the first positioning part; and a fourth processing subunit, determining whether the water tank is in place according to the image of the first positioning part.

A twenty-first embodiment includes the monitoring apparatus of a cleaning device according to any one of the eighteenth or twentieth embodiment, in which a cleaning assembly includes a dust box, and the dust box includes a second positioning part; the apparatus further includes: a second acquiring unit, acquiring an image of the second positioning part; and a second processing unit, determining whether the dust box is in place according to the image of the second positioning part.

A twenty-second embodiment includes a non-temporary computer-readable storage medium, the computer-readable storage medium stores computer instructions, and the computer instructions, when executed by a processor, implement steps of a monitoring method of the cleaning device according to any one of the fourteenth to seventeenth embodiments.

What is claimed is:

1. A cleaning device, comprising:

a main unit;

a cleaning assembly, arranged on the main unit, wherein the cleaning assembly at least comprises a water tank; and at least one image collection module, corresponding to the water tank in position and arranged facing the water tank, wherein the at least one image collection module collects an image of the water tank, so as to determine at least one of whether the water tank is in place and a water volume status of the water tank.

2. The cleaning device according to claim 1, wherein the main unit comprises an image analysis module, and the image analysis module is electrically connected to the image collection module, so as to acquire and analyze the image of the water tank.

3. The cleaning device according to claim 1, wherein the cleaning device further comprises a limit fixing piece, the limit fixing piece is in limit fit with the image collection module, and the limit fixing piece is fixedly connected to the main unit.

4. The cleaning device according to claim 3, wherein the limit fixing piece comprises a cover plate, the cover plate is arranged above the image collection module in a thickness direction of the cleaning device, and the cover plate is fixedly connected to the main unit.

5. The cleaning device according to claim 3, wherein the main unit comprises a bottom plate, and the cleaning device further comprises a light transmission piece assembled on the bottom plate and located between the image collection module and the water tank; and the image collection module comprises a main body structure and a lens arranged on the main body structure, and the light transmission piece, the limit fixing piece, the bottom plate and the main body structure enclose a sealed space for accommodating the lens.

6. The cleaning device according to claim 5, wherein the bottom plate comprises a base plate and an extension wall arranged on the base plate, and the extension wall is provided with an open hole corresponding to the lens in position; and the light transmission piece is adhered to the extension wall by a sealing adhesive, and the light transmission piece blocks the open hole.

7. The cleaning device according to claim 1, wherein the image collection module is fixedly assembled on the water tank.

8. The cleaning device according to claim 1, wherein the water tank comprises a housing that encloses a water storage space and a water level observation part arranged on the housing; and an assembly surface of the housing facing the main unit is provided with a concave part recessed relative to the assembly surface, and the main unit comprises an assembly structure fitted to the concave part; and the image collection module is assembled into an assembly space enclosed by the assembly structure, and the water level observation part is arranged on a first side wall forming the concave part.

9. The cleaning device according to claim 8, wherein the first side wall is arranged obliquely relative to the assembly surface.

10. The cleaning device according to claim 8, wherein the water level observation part comprises a light transmission structure forming at least a portion of the first side wall.

11. The cleaning device according to claim 1, wherein the water tank comprises a first positioning part; and the image of the water tank comprises an image of the first positioning part, so as to judge whether the water tank is in place according to the image of the first positioning part.

12. The cleaning device according to claim 1, wherein the cleaning assembly further comprises a dust box; and the at least one image collection module corresponds to a second positioning part of the dust box in position, and the image collection module acquires an image of the second positioning part, so as to judge whether the dust box is in place according to the image of the second positioning part.

13. The cleaning device according to claim 1, wherein the cleaning device comprises a base station;

the water tank comprises a clean water tank or a dirty water tank; and the main unit comprises a base station main unit.

14. The cleaning device according to claim 1, wherein the cleaning device comprises a cleaning main body;

the water tank comprises a clean water tank or a dirty water tank; and the main unit comprises a cleaning main body main unit.

15. The cleaning device according to claim 1, wherein the cleaning device comprises a base station and a cleaning main body;

the water tank comprises a clean water tank or a dirty water tank; and the main unit comprises a base station main unit and a cleaning main body main unit.

16. A monitoring method of a cleaning device, applied to the cleaning device, the method comprises:

acquiring an image of a water tank included in a cleaning assembly, arranged on a main unit, wherein the cleaning assembly at least comprises the water tank; and determining at least one of whether the water tank is in place and a water volume status of the water tank according to the image of the water tank using at least one image collection module, corresponding to the water tank in position and arranged facing the water tank, wherein the at least one image collection module collects an image of the water tank, so as to determine at least one of whether the water tank is in place and a water volume status of the water tank.

17. The monitoring method of the cleaning device according to claim 16, wherein determining the water volume status of the water tank according to the image of the water tank, comprises:

sending a signal that the water tank is in a full-tank water volume status in a case that the image of the water tank matches an image feature of a preset full-tank water level;

sending a signal that the water tank is in a half-tank water volume status in a case that the image of the water tank matches an image feature of a preset half-tank water level; and sending a signal that the water tank is in an empty-tank water volume status in a case that the image of the water tank matches an image feature of a preset empty-tank water level.

18. The monitoring method of the cleaning device according to claim 16, wherein the water tank comprises a first positioning part, and determining whether the water tank is in place according to the image of the water tank comprises:

acquiring an image of the first positioning part, wherein the image of the water tank comprises the image of the first positioning part; and determining whether the water tank is in place according to the image of the first positioning part.

19. The monitoring method of the cleaning device according to claim 16, wherein a cleaning assembly comprises a dust box, and the dust box comprises a second positioning part; and the method further comprises:

acquiring an image of the second positioning part; and determining whether the dust box is in place according to the image of the second positioning part.

* * * * *